US008801239B2

(12) United States Patent
Abdelsamed et al.

(10) Patent No.: US 8,801,239 B2
(45) Date of Patent: Aug. 12, 2014

(54) LIGHT EMITTING DIODE LUMINAIRES AND APPLICATIONS THEREOF

(75) Inventors: Yaser Abdelsamed, Granville, OH (US); Stacy Hoch, Newark, OH (US); Chris Rice, New Philadelphia, OH (US)

(73) Assignee: ABL IP Holding LLC, Conyers, GA (US)

( * ) Notice: Subject to any disclaimer, the term of this patent is extended or adjusted under 35 U.S.C. 154(b) by 587 days.

(21) Appl. No.: 12/637,242

(22) Filed: Dec. 14, 2009

(65) Prior Publication Data

US 2010/0149804 A1 Jun. 17, 2010

Related U.S. Application Data

(60) Provisional application No. 61/122,112, filed on Dec. 12, 2008.

(51) Int. Cl.

| | |
|---|---|
| ***F21S 8/00*** | (2006.01) |
| ***F21S 13/10*** | (2006.01) |
| ***F21S 8/08*** | (2006.01) |
| ***F21S 6/00*** | (2006.01) |
| ***F21V 13/04*** | (2006.01) |
| *F21W 111/02* | (2006.01) |
| *F21W 131/103* | (2006.01) |

(52) U.S. Cl.

CPC ..... *F21S 8/088* (2013.01); *F21S 6/005* (2013.01); *F21S 8/032* (2013.01); *F21V 13/04* (2013.01); *F21W 2111/02* (2013.01); *F21W 2131/103* (2013.01); *Y10S 362/80* (2013.01)

USPC ..... 362/431; 362/249.02; 362/311.02; 362/328; 362/800

(58) Field of Classification Search

CPC ..... F21S 6/005–6/008; F21S 6/032; F21S 6/085; F21S 6/086; F21S 6/088; F21V 7/008; F21V 13/02; F21V 13/04; F21V 13/06; F21W 2111/02; F21W 2131/10; F21Y 2101/02

USPC ..... 362/235, 245, 249.02, 297–308, 362/311.02, 326–328, 346, 800

See application file for complete search history.

(56) References Cited

U.S. PATENT DOCUMENTS

| | | | | |
|---|---|---|---|---|
| 5,825,137 | A * | 10/1998 | Titus | 315/291 |
| 6,607,286 | B2 | 8/2003 | West et al. | |
| 7,431,480 | B2 | 10/2008 | Godo | |
| 2007/0263376 | A1 * | 11/2007 | Wilkinson et al. | 362/35 |
| 2011/0204242 | A1 | 8/2011 | Hoch et al. | |

OTHER PUBLICATIONS

Non-Final Office Action for U.S. Appl. No. 12/710,625, mailed Mar. 13, 2012 (7 pages).

Amendment and Response to Office Action for U.S. Appl. No. 12/710,625, filed Jun. 13, 2012 (11 pages).

* cited by examiner

*Primary Examiner* — Jason Moon Han

(74) *Attorney, Agent, or Firm* — Kilpatrick Townsend & Stockton, LLP

(57) ABSTRACT

The present invention relates to luminaires and, in particular, to luminaires comprising light emitting diodes. In one embodiment, the present invention provides a luminaire comprising at least one light emitting diode, a reflector offset from the centerline of the luminaire and a collimator adapted to direct light from the least one light emitting diode along an axis offset from the vertical axis of the light emitting diode.

17 Claims, 5 Drawing Sheets

LIGHT EMITTING DIODE LUMINAIRES AND APPLICATIONS THEREOF

CROSS REFERENCE TO RELATED APPLICATION

This application claims the benefit of U.S. Provisional patent application Ser. No. 61/122,112, filed Dec. 12, 2008, which is incorporated herein by this reference.

FIELD OF THE INVENTION

The present invention relates to luminaires and, in particular, to luminaires comprising light emitting diodes (LEDs).

BACKGROUND OF THE INVENTION

Luminaires for providing general illumination to an area are well known and often used in outdoor lighting applications including roadway and sidewalk lighting, parking lot lighting, and residential area lighting. In order to increase luminaire efficiency, light emitting diodes have been incorporated into luminaire designs as a light source. Light emitting diodes offer several advantages including high lighting efficiency, long lifetimes that can exceed 50,000 hours of operation, resistance to physical or mechanical shock and rapid lighting response time.

Conversely, light emitting diodes additionally exhibit several disadvantages which challenge their use in luminaire constructions, including luminaires used for general outdoor illumination. The performance of a light emitting diode, for example, is largely dependent on the temperature of the operating environment. Operating a light emitting diode in high ambient temperatures can lead to overheating and device failure. Moreover, light emitting diodes are generally offered in relatively low lumen packages, necessitating large numbers to create the required lighting levels. As a result, it is difficult to produce a light emitting diode luminaire having the size, shape and light output of existing high intensity discharge (HID) luminaires.

SUMMARY

In view of the foregoing, it would be desirable to provide luminaires that incorporate the advantages of light emitting diode light sources while maintaining the structural and performance characteristics of existing HID fixtures.

In one aspect, the present invention provides luminaires comprising light emitting diodes as a light source which demonstrate structural and performance characteristics similar to existing HID luminaires. In some embodiments, a luminaire of the present invention comprises at least one light emitting diode, a reflector offset from the centerline of the luminaire and a collimator adapted to direct light from the least one light emitting diode along an axis offset from the vertical axis of the light emitting diode.

In another embodiment, a luminaire of the present invention comprises a plurality of light emitting diodes, a reflector offset from the centerline of the luminaire and a plurality of collimators, wherein at least one of the collimators is adapted to direct light from at least one of the light emitting diodes along an axis offset from the vertical axis of the light emitting diode.

In some embodiments, luminaires of the present invention further comprise a planar mounting surface, wherein a plurality of light emitting diodes are attached to the planar mounting surface. The planar mounting surface, in some embodiments, is coupled to the housing of the luminaire, thereby providing an efficient pathway for heat flow or heat transfer from the light emitting diodes to the housing for dissipation in the surrounding environment.

Luminaires of the present invention, in some embodiments, are suitable for use in a wide variety of applications including outdoor lighting applications such as roadway and sidewalk lighting, parking lot lighting and residential area lighting.

These and other embodiments are described in greater detail in the detailed description which follows.

DETAILED DESCRIPTION

The present invention provides luminaires comprising light emitting diodes as a light source which demonstrate structural and performance characteristics similar to existing HID luminaires.

In some embodiments, a luminaire of the present invention comprises at least one light emitting diode, a reflector offset from the centerline of the luminaire and a collimator adapted to direct light from the least one light emitting diode along an axis offset from the vertical axis of the light emitting diode.

In another embodiment, a luminaire comprises a plurality of light emitting diodes, a reflector offset from the centerline of the luminaire and a plurality of collimators, wherein at least one of the collimators is adapted to direct light from at least one of the light emitting diodes along an axis offset from the vertical axis of the light emitting diode.

Figure 1:
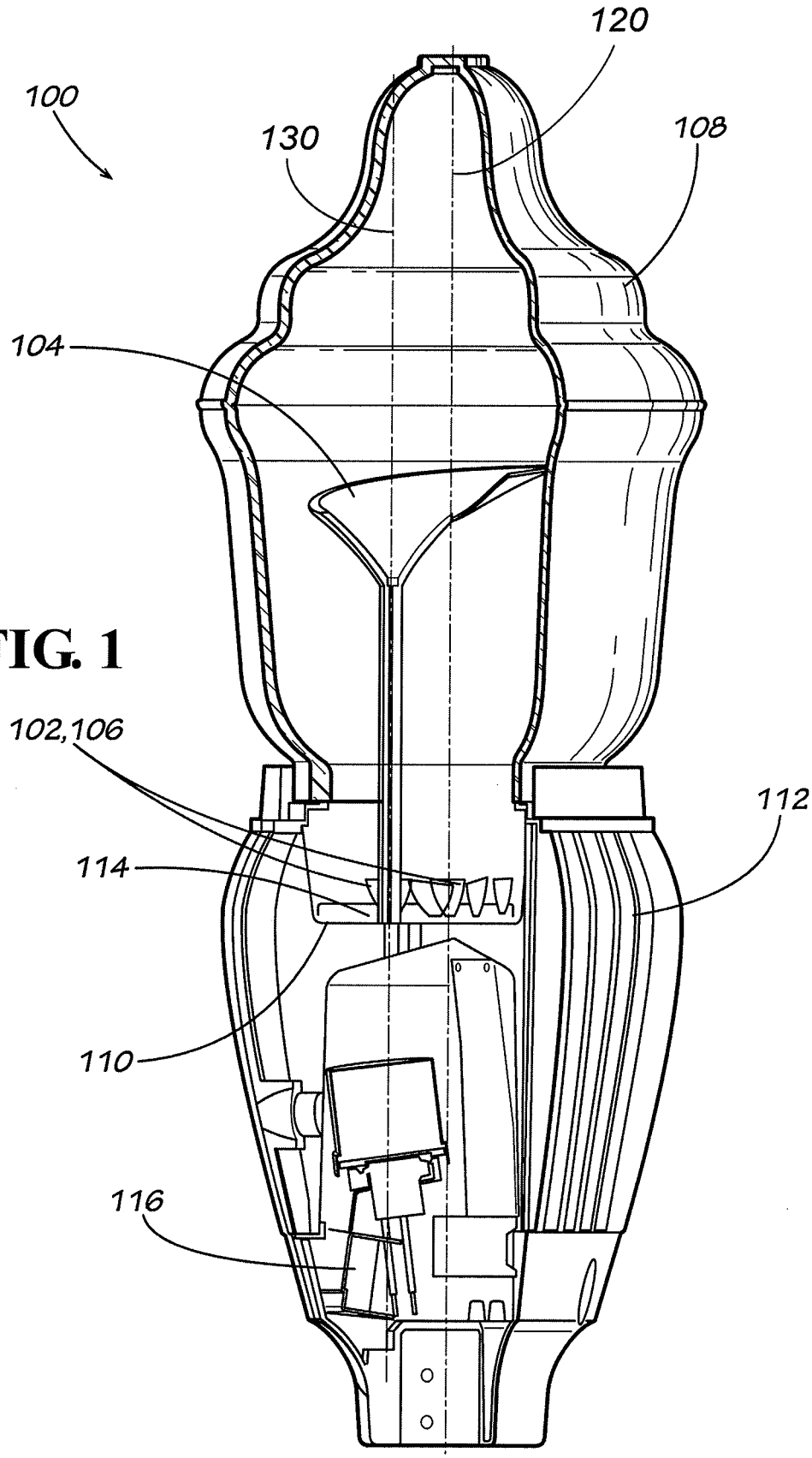
FIG. 1 illustrates a cut-away perspective view of a luminaire according to one embodiment of the present invention.

Turning now to the figures, FIG. 1 illustrates a cut-away perspective view of a luminaire according to one embodiment of the present invention. As provided in FIG. 1, the luminaire (100) comprises a plurality of light emitting diodes (102) and a reflector (104) offset from the centerline (120) of the luminaire (100). Offsetting the reflector (104) from the centerline of luminaire (100) can create more area under the reflector (104) dedicated to the light emitting diodes (102) for lighting applications, such as street-side lighting.

Figure 5:
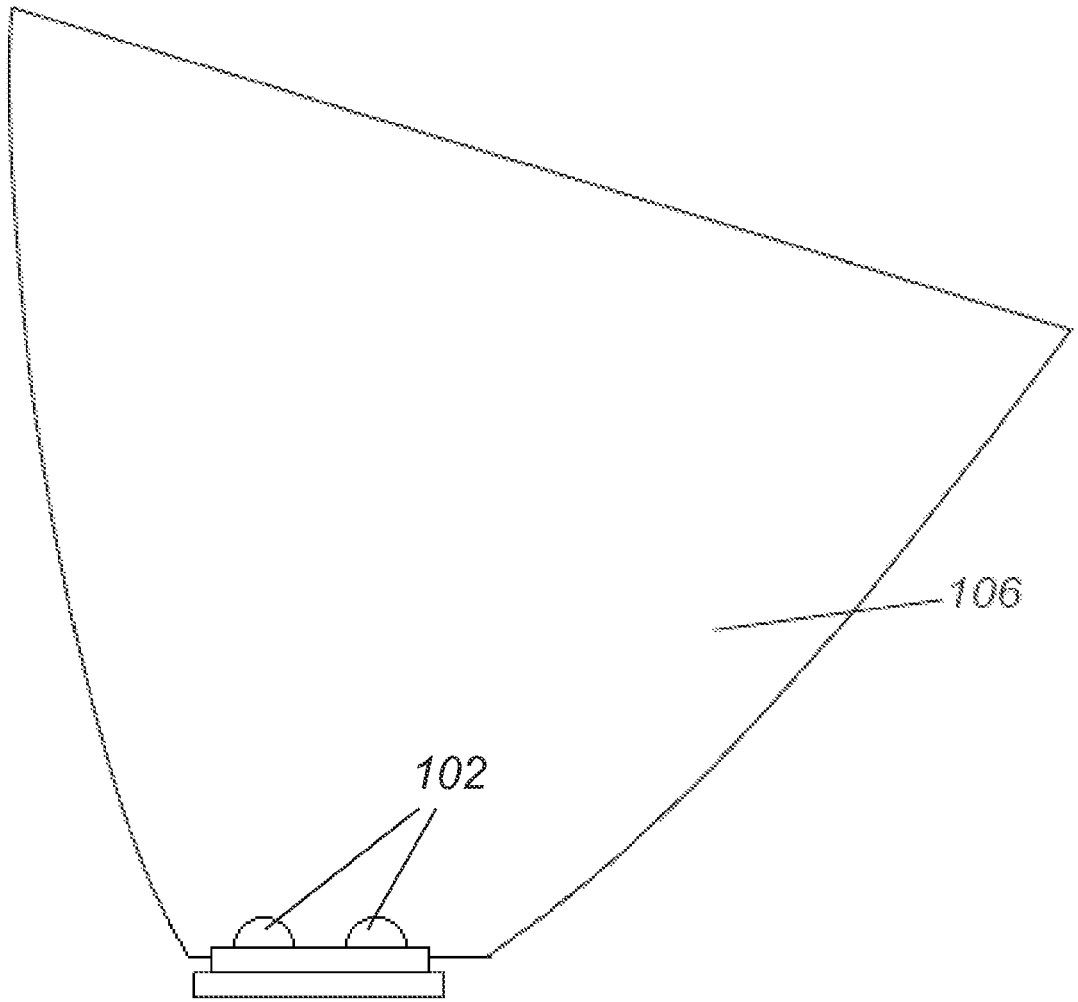
FIG. 5 illustrates a cross-sectional view of a light emitting diode in conjunction with a collimator according to an embodiment of the present invention.

The luminaire (100) additionally comprises a plurality of collimators (106). In the embodiment illustrated in FIG. 1, each collimator (106) is positioned around and associated with a single light emitting diode (102). See FIG. 2. In other embodiments, a collimator is associated with a plurality of light emitting diodes (see FIG. 5) or a plurality of collimators is associated with a single light emitting diode. An outer optic (108) encloses the reflector (104), light emitting diodes (102) and collimators (106). In some embodiments, the outer optic (108) comprises a refractive optic. Moreover, a surge protection device (116) can be incorporated within the housing (112) of the luminaire (100) operable to protect the light emitting diodes from voltage surges and other transient voltage spikes.

Figure 2:
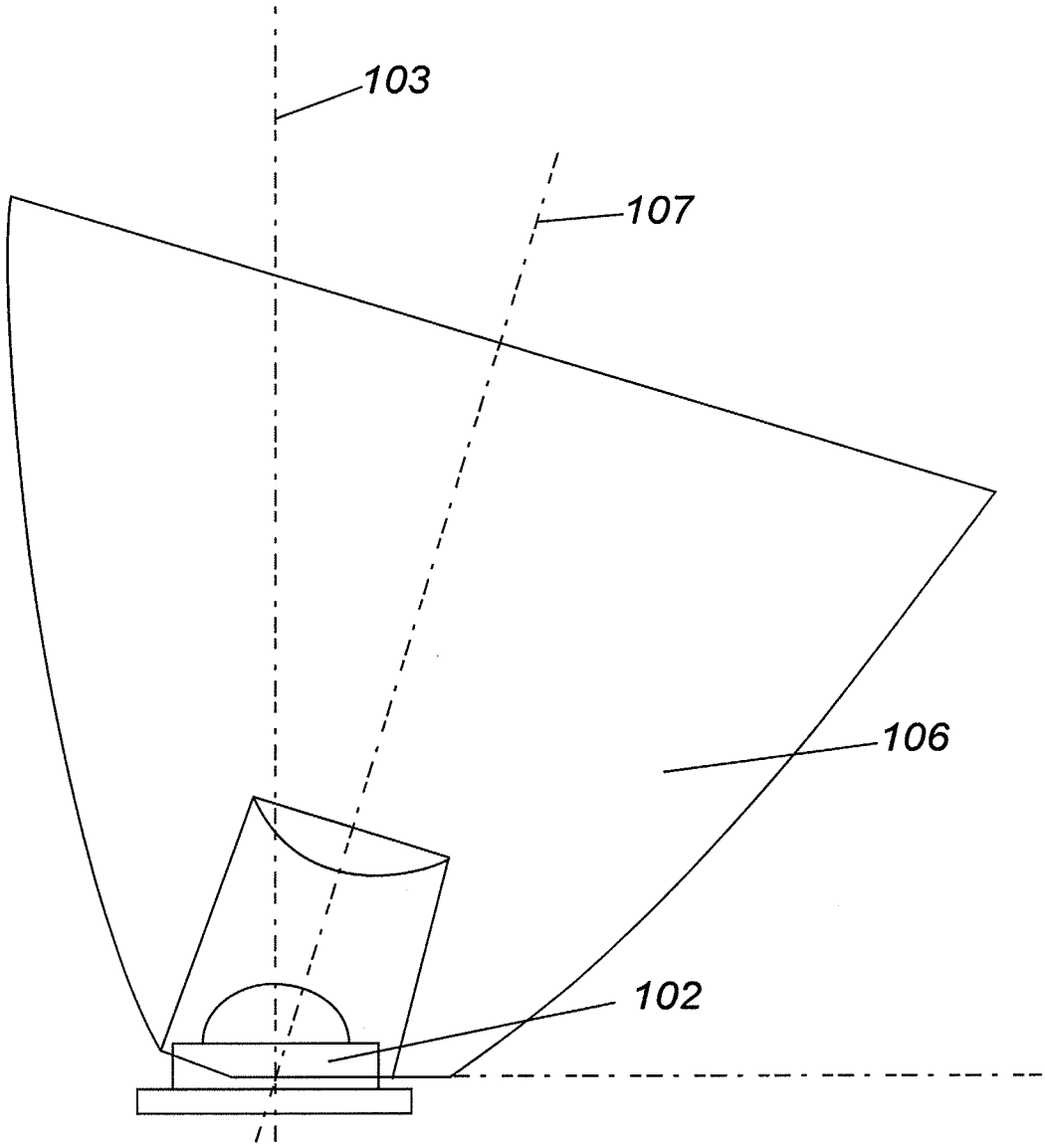
FIG. 2 illustrates a cross-sectional view of a light emitting diode in conjunction with a collimator according to one embodiment of the present invention.

FIG. 2 illustrates a cross-sectional view of light emitting diode (102) in conjunction with a collimator (106) according to one embodiment of the present invention. As illustrated in FIG. 2, the collimator (106) is adapted to collimate and direct light from the light emitting diode (102) along an axis having an angular offset from the vertical axis of the light emitting diode. In some embodiments, the axis (107) along which the collimator (106) directs light from the light emitting diode (102) is offset from the vertical axis (103) of the light emitting diode by a desired angle.

In some embodiments, use of a collimator in conjunction with a light emitting diode, as described herein, can permit aiming the light output of the diode. In some embodiments, the angular offset provided by one collimator in conjunction with a light emitting diode is determined without reference to any other collimator-light emitting diode construction of the luminaire. In other embodiments, the angular offset provided by one collimator in conjunction with a light emitting diode is determined with reference to other collimator-light emitting diode constructions of the luminaire.

The ability to aim the light output of light emitting diodes, in some embodiments, precludes the need for shaped or undulating diode mounting surfaces previously used to vary the directional light output of individual diodes. As a result, in some embodiments, a luminaire of the present invention comprises a planar, or substantially planar, mounting surface, wherein a plurality of light emitting diodes are attached to the surface through a circuit board. Planar light emitting diode mounting surfaces are easier and less complicated to manufacture in comparison with shaped and/or undulating mounting surfaces. Referring again to FIG. 1, the light emitting diodes (102) are attached to a planar mounting surface (110) through a circuit board (114).

In some embodiments, the planar mounting surface is coupled to or continuous with the housing (112) of the luminaire, thereby providing an efficient pathway for heat flow or heat transfer from the light emitting diode assembly to the housing (112) and on to the surrounding environment. Attaching the light emitting diode circuit board to the planar mounting surface, for example, provides direct optical and thermal paths for the efficient transfer or heat. In such embodiments, the housing (112) operates as a heat sink to conduct heat away from the light emitting diodes and subsequently dissipate the heat through an external convection system.

In some embodiments, the housing (112) comprises one or more structures which facilitate heat dissipation. In one embodiment, for example, the housing (112) comprises a plurality of fins or other structures designed to increase convective air currents across surfaces of the housing (112) for heat dissipation. In some embodiments, such structures are continuous with the housing. In other embodiments, heat dissipation structures are attached to the housing (112) through mechanical or adhesive engagement. Moreover, in some embodiments, a housing (112) further comprises one or more covers or panels adapted to cover the heat dissipation structures. In some embodiments, these covers or panels work in conjunction with heat dissipation structures to increase convective air currents on surfaces of the housing.

As a result, in some embodiments, a luminaire of the present invention does not require heat pipes, such as those constructed from copper or aluminum, to conduct heat from the light emitting diodes. Efficient transfer of heat from light emitting diodes can maintain junction temperature leading to minimal losses from thermal and lumen depreciation.

Figure 3:
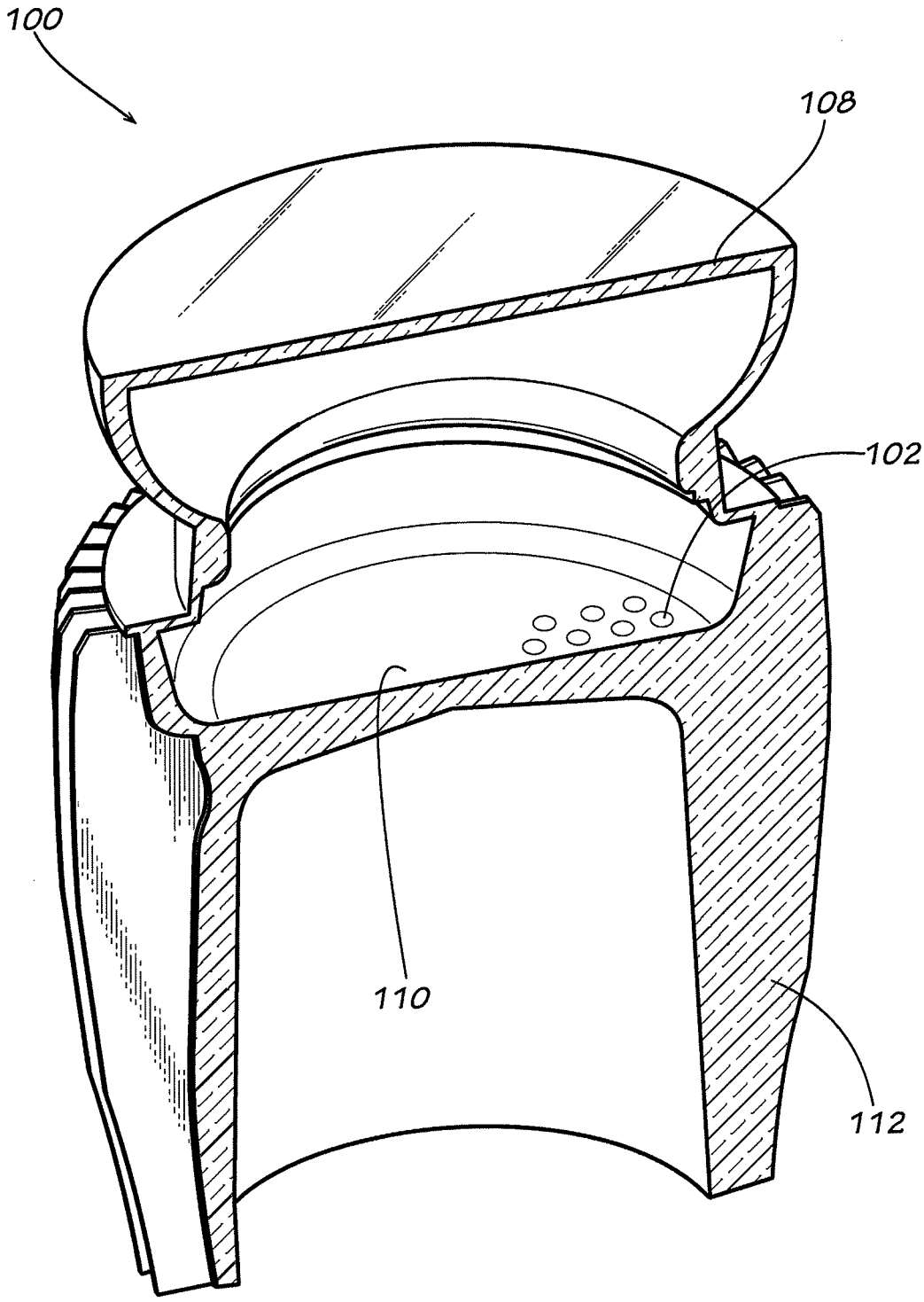
FIG. 3 illustrates a cut-away perspective view of a luminaire according to one embodiment of the present invention.

FIG. 3 illustrates another cross-sectional view of a luminaire according to one embodiment of the present invention. The light emitting diodes (102) are attached to a planar mounting surface (110). Moreover, the planar mounting surface (100) is directly coupled to the housing (112) of the luminaire (100). Heat generated by the light emitting diodes (102) is transferred to the housing (112) through the planar mounting surface (110).

Figure 4:
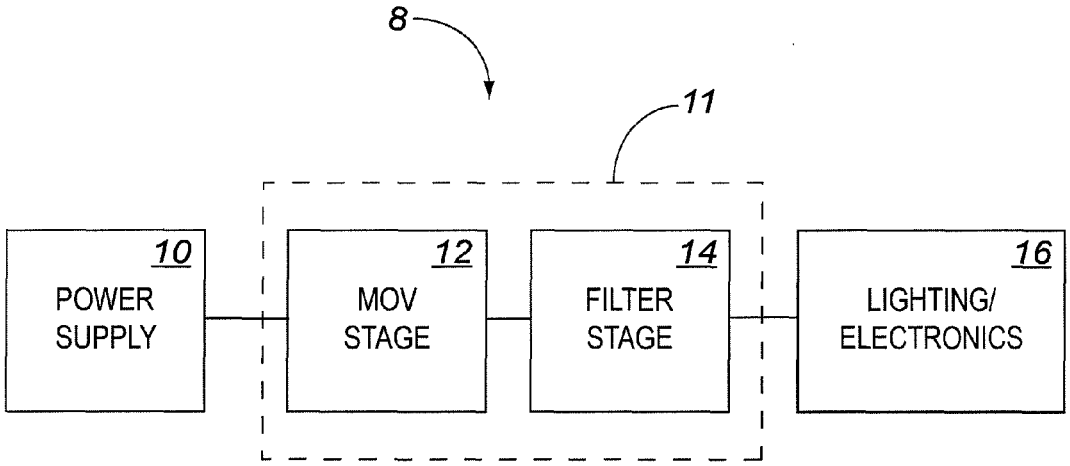
FIG. 4 is a generalized block diagram illustrating a circuit configured in accordance with some aspects of the present invention.

As provided herein, in some embodiments, a luminaire of the present invention additionally comprises a surge protection device operable to protect the light emitting diodes from voltage surges and other transient voltage spikes. FIG. 4 is a generalized block diagram illustrating a circuit configured in accordance with some aspects of the present invention. The circuit (8) comprises a surge protection device (11) between a power supply/source (10) and a lighting system comprising light emitting diodes (16) as described herein. In this example, the surge protection device (11) comprises a metal oxide varistor (MOV) stage (12) and a filter stage (14). Embodiments of a surge protector suitable for use in the luminaire (100) are described in U.S. patent application Ser. Nos. 12/625,767 and 12/607,528, the disclosures of which are incorporated by reference herein in their entirety.

The construction of luminaires of the present invention achieve light outputs comparable to existing HID fixtures, rendering the luminaires of the present invention suitable for use in a wide variety of applications including outdoor lighting applications such as roadway and sidewalk lighting, parking lot lighting and residential area lighting.

Various embodiments of the invention have been described in fulfillment of the various objectives of the invention. It should be recognized that these embodiments are merely illustrative of the principles of the present invention. Numerous modifications and adaptations thereof will be readily apparent to those of skill in the art without departing from the spirit and scope of the invention.

What is claimed is:

1. A street luminaire, the street luminaire having a geometric center extending vertically therethrough defining a centerline and comprising:

at least one light emitting diode having a first optical axis;

at least one solid collimator having a second optical axis, the second optical axis angularly offset from the first optical axis such that light emitted from the at least one light emitting diode exits the solid collimator at an angle offset from the first optical axis; and a stationary reflector offset from the centerline of the street luminaire, wherein the reflector is mounted to the street luminaire on a shaft, and the shaft is offset from the centerline of the street luminaire.

2. The street luminaire of claim 1, wherein the at least one light emitting diode comprises a plurality of light emitting diodes and wherein the at least one solid collimator comprises a plurality of solid collimators.

3. The street luminaire of claim 1, wherein the at least one light emitting diode comprises a plurality of light emitting diodes and wherein one of the at least one solid collimators is adapted to direct light from at least some of the plurality of light emitting diodes.

4. The street luminaire of claim 1, further comprising an outer optic enclosing the reflector.

5. The street luminaire of claim 4, wherein the outer optic is a refractive optic.

6. The street luminaire of claim 1, further comprising a surge protection device.

7. The street luminaire of claim 6, wherein the surge protection device comprises a metal oxide varistor stage and a filter stage.

8. The street luminaire of claim 1, wherein the at least one light emitting diode is attached to a substantially planar mounting surface.

9. The street luminaire of claim 8, wherein the at least one light emitting diode is attached to the substantially planar mounting surface through a circuit board.

10. The street luminaire of claim 8, wherein the street luminaire comprises a housing, wherein the substantially planar mounting surface is coupled to or continuous with the housing.

11. The street luminaire of claim 10, wherein the housing operates as a heat sink to conduct heat away from the at least one light emitting diode.

12. The street luminaire of claim 1, wherein the street luminaire comprises a housing, and wherein the housing comprises a heat dissipation structure.

13. The street luminaire of claim 12, wherein the heat dissipation structure comprises one or more fins.

14. The street luminaire of claim 12, wherein the heat dissipation structure is continuous with the housing.

15. The street luminaire of claim 12, wherein the heat dissipation structure is attached to the housing through mechanical or adhesive engagement.

16. The street luminaire of claim 12, wherein the housing further comprises at least one cover or panel adapted to cover the heat dissipation structure.

17. The street luminaire of claim 1, wherein the luminaire does not include a heat pipe for conducting heat from the one or more light emitting diode.

* * * * *